US007450135B2

(12) United States Patent
Kim

(10) Patent No.: US 7,450,135 B2
(45) Date of Patent: Nov. 11, 2008

(54) DISPLAY DEVICE FOR DETECTING ABNORMAL IMAGE SIGNAL AND METHOD THEREOF

(75) Inventor: Young-chan Kim, Anyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 125 days.

(21) Appl. No.: 10/617,229

(22) Filed: Jul. 11, 2003

(65) Prior Publication Data

US 2004/0017367 A1 Jan. 29, 2004

(30) Foreign Application Priority Data

Jul. 11, 2002 (KR) ..... 2002-40408

(51) Int. Cl.
*G09G 5/02* (2006.01)

(52) U.S. Cl. ..... 345/593; 345/594; 345/589; 345/597; 345/600

(58) Field of Classification Search ..... 345/593, 345/594, 589, 597, 600
See application file for complete search history.

(56) References Cited

U.S. PATENT DOCUMENTS 4,772,948 A 9/1988 Irvin
5,644,325 A * 7/1997 King et al. ..... 345/20
5,809,366 A * 9/1998 Yamakawa et al. ..... 399/39
5,999,148 A 12/1999 Park
6,081,254 A * 6/2000 Tanaka et al. ..... 382/167
6,323,828 B1 11/2001 Perez
6,566,857 B1 5/2003 Kakizawa et al.
6,744,917 B1 * 6/2004 Sadowski et al. ..... 382/162
2001/0023492 A1 9/2001 Cheng et al.
2002/0080128 A1 6/2002 Park et al.
2002/0163570 A1 * 11/2002 Phillips ..... 347/224
2003/0142110 A1 * 7/2003 Murashita ..... 345/600

FOREIGN PATENT DOCUMENTS

JP 07-303262 11/1995
KR 2002-0029836 4/2002

OTHER PUBLICATIONS

European Search Report for corresponding European Patent Application No. 03254397.7 dated Jun. 19, 2007 (in English).

* cited by examiner

*Primary Examiner*—Matthew C. Bella
*Assistant Examiner*—Mike Rahmjoo
(74) *Attorney, Agent, or Firm*—Staas & Halsey LLP

(57) ABSTRACT

A method and a display device for detecting an abnormal video signal by periodically checking R,G,B signals. The method includes selecting an R,G,B signal and setting a region of the selected signals to be checked; detecting a minimum pixel level value in the region of the selected R,G,B signal; comparing the minimum pixel level value for the selected R,G,B signal with a predetermined threshold value and checking if abnormal R,G,B signal are present; and displaying on a screen a message indicating whether the selected R,G,B signal is abnormal.

16 Claims, 4 Drawing Sheets

DISPLAY DEVICE FOR DETECTING ABNORMAL IMAGE SIGNAL AND METHOD THEREOF

CROSS-REFERENCE TO RELATED APPLICATIONS

This application claims the priority of Korean Patent Application No. 2002-40408, filed Jul. 11, 2002 in the Korean Intellectual Property Office (KIPO), which is incorporated herein in its entirety by reference.

BACKGROUND OF THE INVENTION

1. Field of the Invention

The present invention relates to a display system, and more particularly, to a display device checking whether input R,G,B data is normal and a method of detecting an abnormal image signal.

2. Description of the Related Art

Generally, computer systems include a host and a display device. The display device receives Red, Green, Blue (RGB) signals, a horizontal synchronization signal H sync, and a vertical synchronization signal V sync from the host, and displays the received signals on a screen.

Whenever the display device receives an abnormal horizontal synchronization signal or an abnormal vertical synchronization signal from the host, the display device operates according to a suspend mode, a standby mode, or an off mode and informs a user of the generation of this abnormal signal. In the suspend mode, a horizontal synchronization signal is detected but a vertical synchronization signal is not detected. In the standby mode, the vertical synchronization signal is detected but the horizontal synchronization signal is not detected. In the off mode, both the vertical and horizontal synchronization signals are not detected. The display device also informs the user of the input of a vertical/horizontal synchronization signal that does not fall within a signal range prescribed in specifications.

However, even if both the vertical and horizontal synchronization signals are input normally, any, or all of the RGB signals may be abnormally input due to the malfunction of the host. In this case, it is difficult for a user to determine whether the abnormal input of a signal is caused by the malfunction of the display device or the malfunction of the host. Therefore, the user must reboot the host or turn the display device off and on to solve this problem. That is, with a conventional display device, it is difficult to check whether a system is operating normally or abnormally if an R, G or B signal is abnormally input to the display device.

SUMMARY OF THE INVENTION

The present invention provides a method of determining whether a video signal is normal or abnormal by checking a selected R,G,B signal input from a host, and providing a user with the determination result.

The present invention also provides a display device capable of detecting an abnormal video signal.

Additional aspects and advantages of the invention will be set forth in part in the description which follows and, in part, will be obvious from the description, or may be learned by practice of the invention.

According to one aspect of the present invention, there is provided a method of detecting an abnormal video signal in a display device. The method includes selecting an R,G,B signal and setting a region of the selected R,G,B signal to be checked; detecting a minimum pixel level value in the checked region of the selected R,G,B signal; comparing the minimum pixel level value for the selected R,G,B signal with a predetermined threshold value and checking if an abnormal R,G,B signal is present; and displaying on a screen a message indicating whether the selected R,G,B signals are abnormal.

According to another aspect of the present invention, there is provided a display device comprising a signal inputting unit receiving R,G,B video signals, a horizontal synchronization signal, and a vertical synchronization signal; a minimum value detector detecting a minimum level value in a particular region of a selected R,G,B signal input from the signal inputting unit; a controller comparing the minimum pixel level value with a predetermined threshold value and checks if the selected R,G,B signal is abnormal or not; and a warning message indicating the abnormal states of the selected R,G,B signal that is determined by the controller.

BRIEF DESCRIPTION OF THE DRAWINGS

The above and/or other aspects and advantages of the present invention will become more apparent by describing in detail preferred embodiments thereof with reference to the attached drawings in which.

DETAILED DESCRIPTION OF THE PREFERRED EMBODIMENTS

Figure 1:
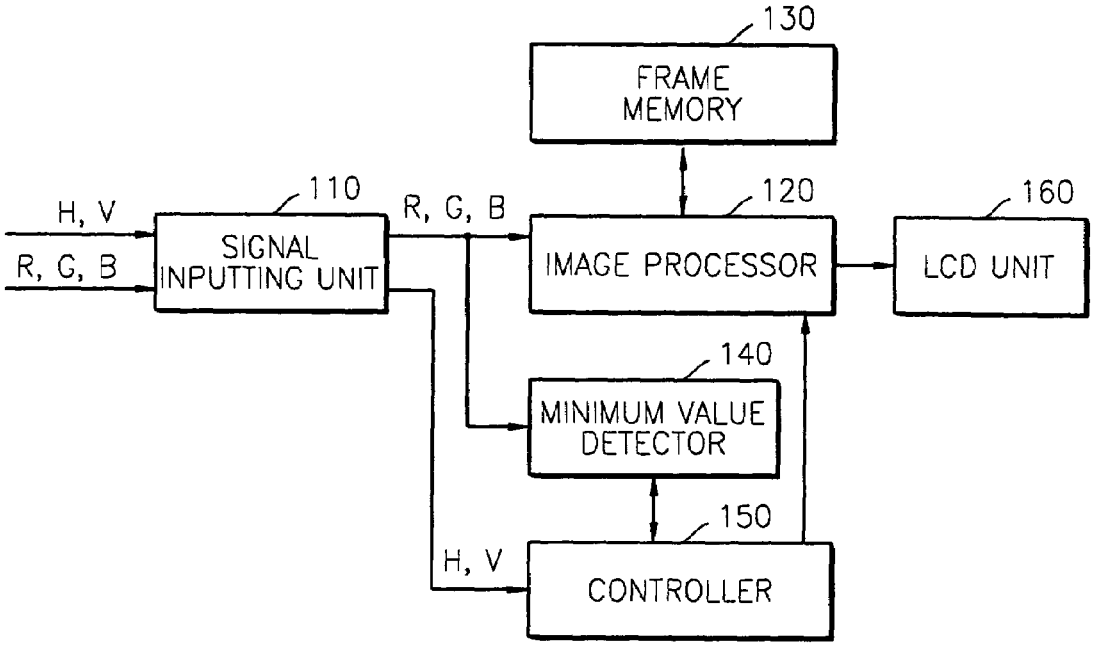
FIG. 1 is a block diagram of a display device according to an embodiment of the present invention.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

FIG. 1 is a block diagram of the overall structure of a display device according to the present invention. Referring to FIG. 1, a signal inputting unit 110 receives R,G,B signals and a vertical/horizontal signal from a host (not shown).

A minimum value detector 140 selects one of the R,G,B signals input from the inputting unit 110 so as to check whether an abnormal video signal is included in the selected R,G,B signals, and detects a minimum level in a particular region of the selected signal.

A controller 150 enables or disables a checking function of an abnormal video signal output from the display device, compares the minimum level of the selected R,G,B signal, which is detected by the minimum value detector 140 with a predetermined level, and finally determines if the selected R,G,B signal is normal or abnormal.

An image processor 120 amplifies the R,G,B signals input from the signal inputting unit 110, mixes the R,G,B signals with an OSD signal, and performs contrast control of the amplified R,G,B signals. In particular, the image processor 120 generates a warning message, as an OSD signal, that indicates the inclusion of any abnormal video signal in the selected R,G,B signal, which is determined by the controller 150, and combines the OSD signal and a video signal.

A frame memory 130 stores, in units of frames, video signals generated by the image processor 120, in units of frames.

A liquid crystal display (LCD) unit 160 outputs a video signal stored in the frame memory 130.

Figure 2:
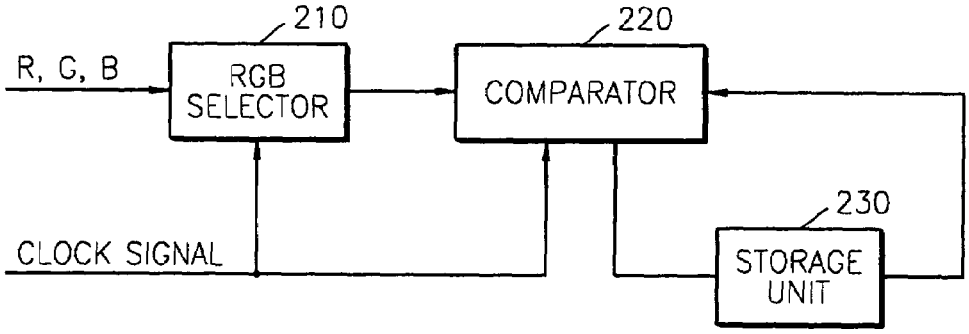
FIG. 2 is a diagram illustrating the structure of a minimum value detector of the display device of FIG. 1.

FIG. 2 is a block diagram illustrating the structure of the minimum value detector 140. Referring to FIG. 2, an R,G,B selector 210 selects one of the R,G,B signals that are input in response to a sampling clock signal to check if an abnormal signal is included in the R,G,B signals.

Figure 3:
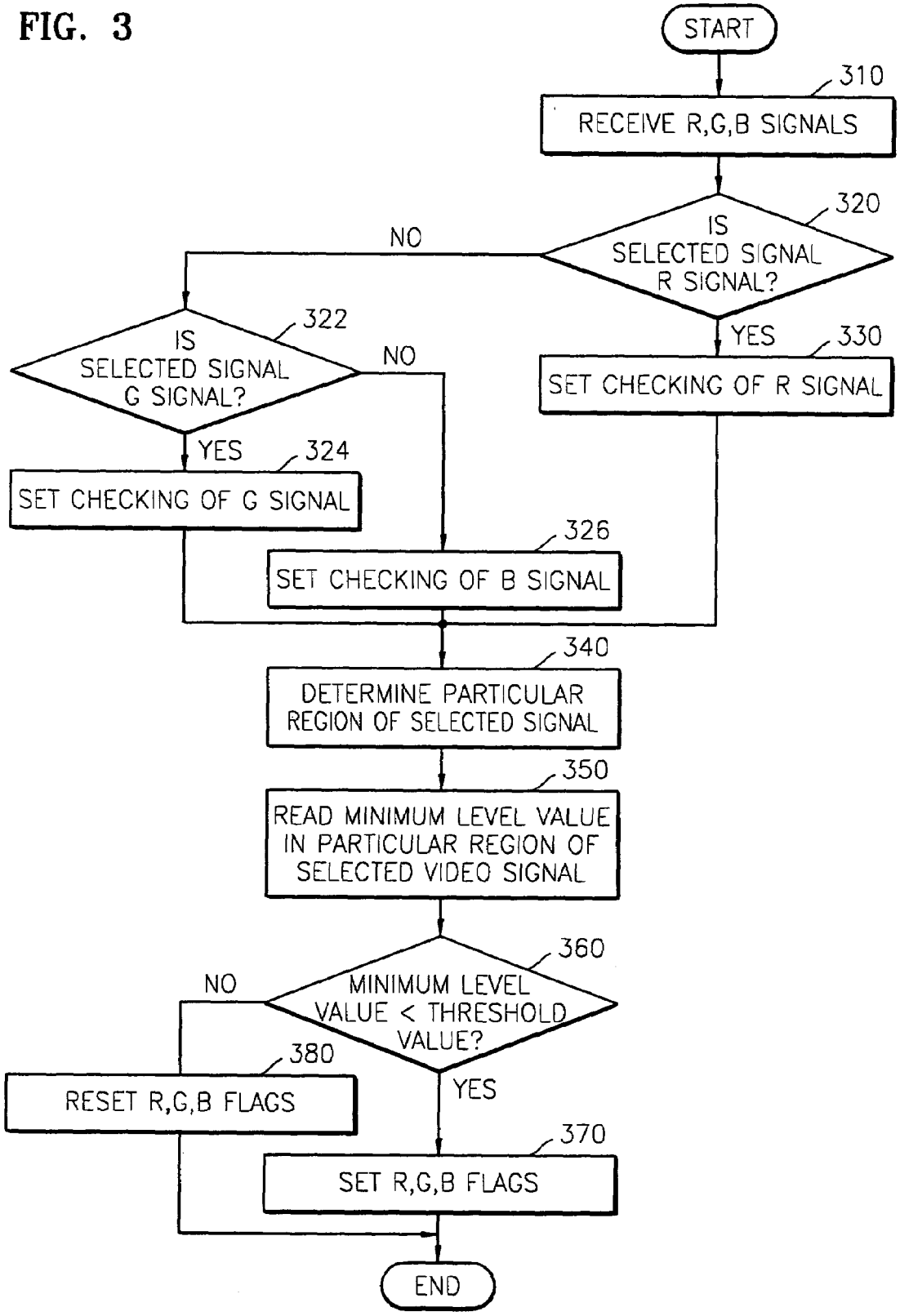
FIG. 3 is a flowchart illustrating a method of sorting out an abnormal image signal input to a display device according to the present invention.

FIG. 3 is a flowchart illustrating a method of detecting an abnormal signal among the R,G,B signals output from a display device according to the present invention. According to the method of FIG. 3, R,G,B signals are received from a host to check whether there is an inclusion of an abnormal video signal in the R,G,B signals 310. One of the R,G,B signals is selected to check the R,G,B signals 320-326. First, whether the selected R,G,B signal is the R signal is checked 320. If the selected R,G,B signal is the R signal, checking of the R signal is set 330. If this is not the case, whether the selected R,G,B signal is the G signal is checked 322. If the selected signal is the G signal, checking of the G signal is set 324. Otherwise, the B signal is checked 326. A determination is then made as to what region of the selected R,G,B signal will be checked 340.

After a predetermined time, a minimum pixel level value in the certain region of the selected R,G,B signal is read 350. The read minimum pixel level value is compared with a predetermined threshold value 360. The threshold value is a reference value that is used to detect the presence of the R,G,B signals.

The minimum pixel level is determined as follows. A comparator 220 compares a pixel level value within a particular region of the signal selected by the R,G,B selector 210 with a pixel level value stored in a storage unit 230, and extracts a minimum pixel level value within a particular region of the video signal.

When the pixel level value in the particular region of the selected signal is identical with a predetermined pixel level value, the comparator 220 considers the pixel level value in the particular region as being a minimum pixel level value. During this process, the comparator 220 compares the minimum pixel level value in the particular region with the predetermined pixel level value in response to a sampling clock signal. In other words, the minimum value detector 140 of FIG. 2 compares the minimum pixel level value in a particular region of a selected video signal with a previous minimum pixel level value and detects a minimum pixel level value in a particular region of a video signal.

If the read minimum level value is smaller than the predetermined threshold value, a flag that indicates that the selected R,G,B, signal is abnormal is set 370. Conversely, if the read minimum level value is larger than that predetermined threshold value, the flag is reset 380. Thus, after operations 370 and 380, flags that indicate whether the selected R,G,B signal is abnormal are set.

Figure 4:
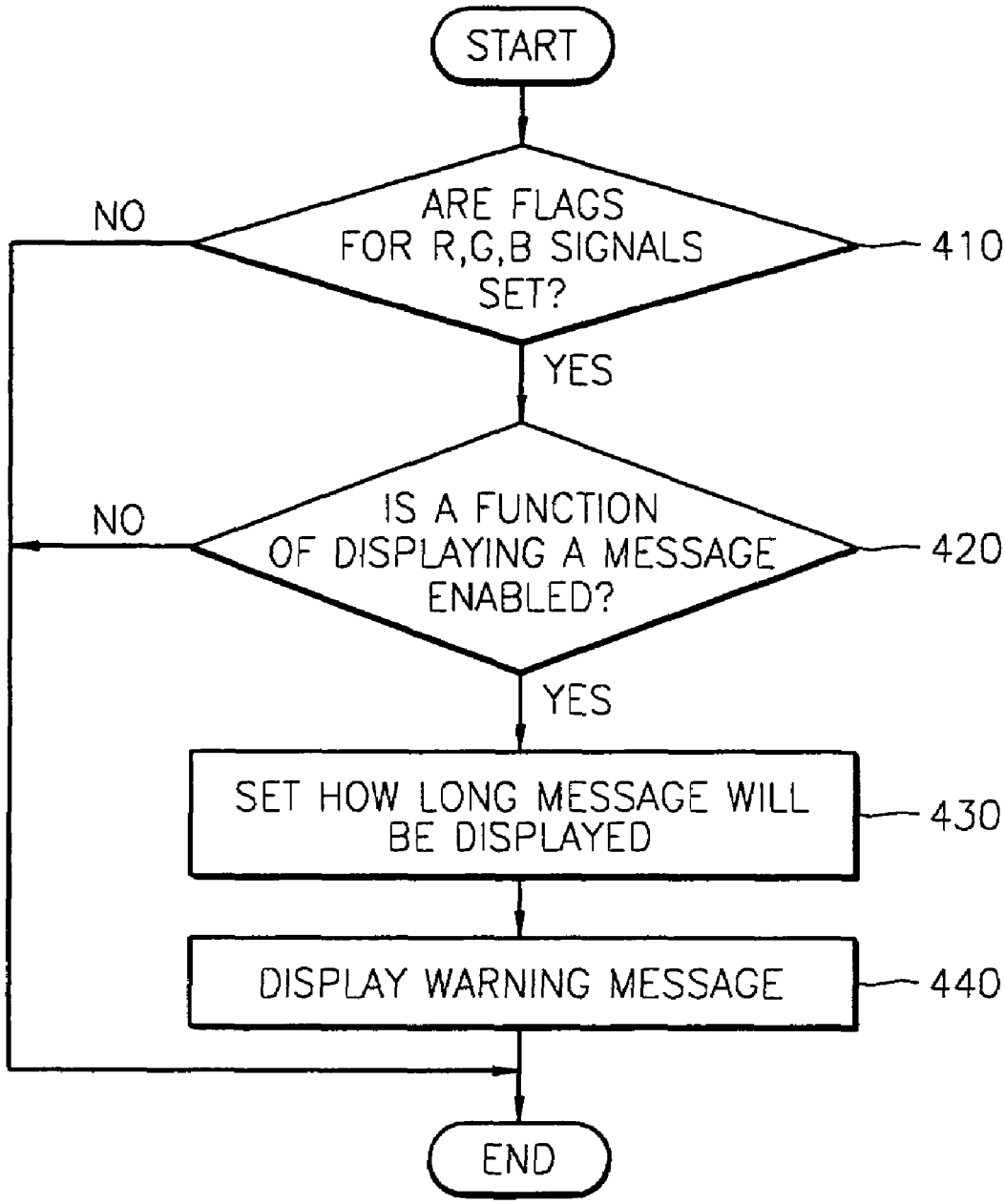
FIG. 4 is a flowchart illustrating a method of delivering a warning message when an abnormal image signal is output from a display device according to the present invention.

FIG. 4 is a flowchart illustrating a method according to the present invention of displaying a warning message indicating that an abnormal R,G,B signal is output from a display device. First, a flag, which indicates that a selected R,G,B signal is abnormal, is checked that it is set to 1 410. Next, when a flag, which indicates all or one of the selected R,G,B signals is abnormal, is set to 1, whether or not a function of displaying a message is enabled is checked 420. When the function of displaying a message is enabled, how long a message will be displayed is determined 430. A warning message is then displayed as an OSD signal on a screen 440.

Figure 5:
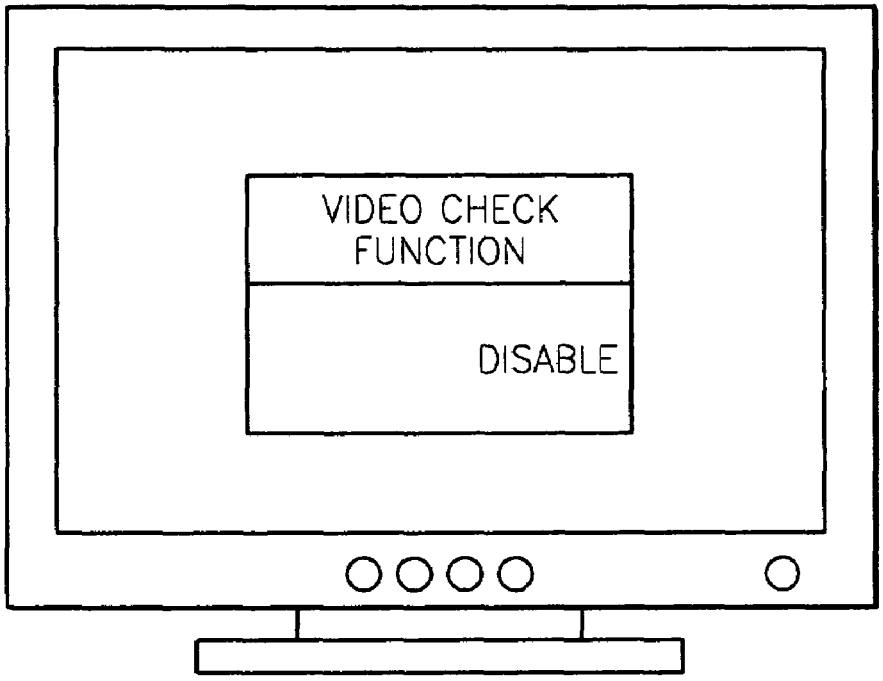
FIG. 5 illustrates an On Screen Display (ODS) menu to enable and disable a function of checking an abnormal video signal in a display device according to the present invention.

FIG. 5 shows an OSD menu which enables or disables a video signal checking function in a display device according to the present invention. Referring to FIG. 5, when a user disables a video signal checking function, the display device displays messages reading "VIDEO CHECK function" and "DISABLE" on a screen.

Figure 6:
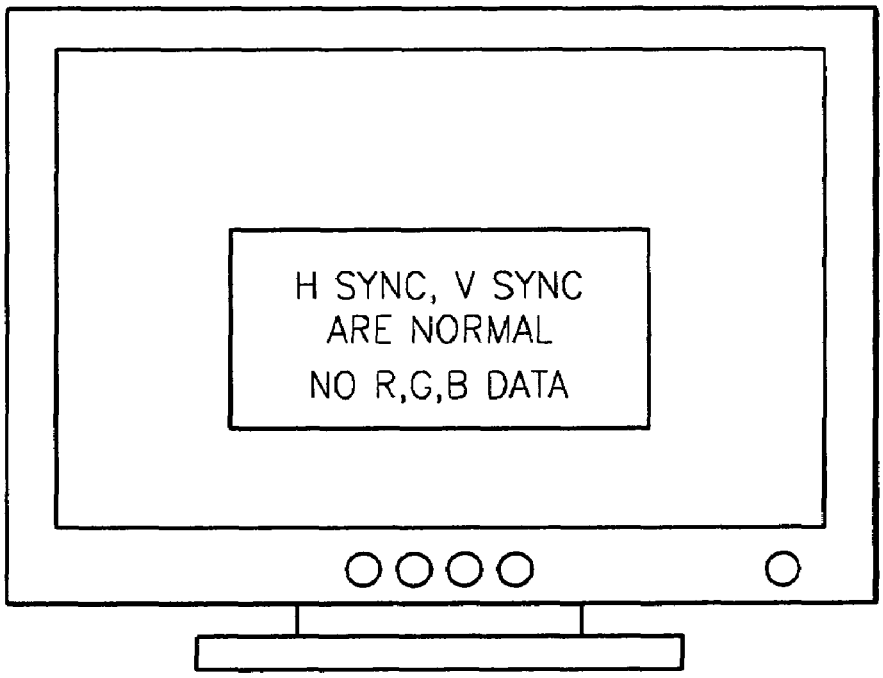
FIG. 6 illustrates an example of a screen of a display device according to the present invention, on which an OSC warning message is displayed.

FIG. 6 shows a screen on which an OSD warning message is displayed when an abnormal R,G,B signal is output from a display device according to the present invention. Referring to FIG. 6, when an abnormal R,G,B signal detecting function is enabled and R,G,B signals are not received, the display device displays messages reading "H SYNC and VSYNC are normal" and "no R,G,B signals" on a screen. Also, if at least one R,G,B signal is abnormal, a warning message is displayed on a screen.

While this invention has been particularly shown and described with reference to preferred embodiments thereof, it will be understood by those skilled in the art that various changes in form and details may be made therein without departing from the spirit and scope of the invention as defined by the appended claims.

As described above, according to the present invention, a display device connected to a host checks R,G,B signals, as well as vertical/horizontal synchronization signals, and displays information indicating whether or not a video signal is normal on a screen. Therefore, a user can easily check whether an abnormal screen is caused by a malfunction of the host or a malfunction of the monitor.

What is claimed is:

1. A method of detecting an abnormal video signal in a display device of a computer system, comprising:

receiving an R,G,B signal including a video signal, a horizontal synchronization signal and a vertical synchronization signal from a host of the computer system;

selecting one of an R, a G, or a B component of the R,G,B signal including the video signal as a selected one R,G, or B component and setting a region of the selected one R,G, or B component as a checked region which is checked;

detecting a minimum pixel level value in the checked region;

comparing the minimum pixel level value for the selected one R,G, or B component with a predetermined threshold value to determine whether an abnormal R,G, or B component is present, the abnormal R,G, or B component being a component abnormally input due to malfunction of the host; and displaying on a screen a message indicating whether the selected one R,G, or B component includes a video signal abnormally input due to the malfunction of the host.

2. The method of claim 1, wherein the comparing comprises:

setting a flag which indicates whether the selected one R,G, or B component is abnormal when the minimum pixel level value is smaller than a predetermined threshold value, and resetting the flag when the minimum pixel level value is larger than the predetermined threshold value.

3. The method of claim 1, wherein the displaying comprises:

checking whether a flag indicating whether the selected one R,G, or B component is abnormal is set;

checking if a video signal checking function is enabled when the flag is set; and setting how long the message will be displayed and how long a predetermined warning message is displayed, when enabling of the video signal checking function is confirmed.

4. A display device comprising:

a signal inputting unit receiving R,G,B signals from a host of a computer system including video signals, a horizontal synchronization signal, and a vertical synchronization signal;

a minimum value detector detecting a minimum pixel level value in a particular region of a selected one of an R, a G, or a B component input from the signal inputting unit, the selected one R,G, or B component being an R, a G, or a B component of the received R,G,B signals;

a controller comparing the minimum pixel level value with a predetermined value to determine whether the selected one R,G, or B component includes an abnormal video signal caused by malfunction of the host; and a warning message indicating an abnormal state of the selected one R,G, or B component caused by malfunction of the host, as determined by the controller.

5. The display device of claim 4, wherein the minimum value detector comprises:

a signal selector selecting one of the received R,G,B components;

a storage unit stores the minimum pixel level value detected in the particular region of the selected one R,G, or B component; and a comparator comparing the minimum pixel level value in the particular region of the selected one R,G, or B component with a stored minimum pixel level value detected in a particular region of a previous R,G,B component, and thereby detects the minimum pixel level value.

6. The display device of claim 4, wherein the controller generates an on-screen-display (OSD) signal that enables and disables an R,G,B, signal checking function.

7. A method of detecting an abnormal video signal in a display device, comprising:

receiving R,G,B signals including video signals, a horizontal synchronization signal, and a vertical synchronization signal from a host of a computer system;

detecting a minimum pixel level value of an R, a G, or a B component selected from the received R,G,B signals, the selected one R,G, or B, component being an R, a G, or a B component of the received R,G,B signals;

determining whether the selected one R,G, or B component is abnormally input due to malfunction of the host, based on a comparison between the minimum pixel level value in the selected one R,G, or B component and a predetermined value; and displaying on a screen a message indicating whether the selected one R,G, or B component includes a video signal abnormally input due to the malfunction of the host.

8. The method of claim 7, wherein the determining comprises:

comparing the minimum pixel level value within the selected one R,G, or B component with the predetermined value;

extracting a minimum pixel level value when the pixel level value in the selected one R,G, or B component is smaller than the predetermined value.

9. The method of claim 7, wherein the determining comprises:

setting a flag indicating whether the selected one R,G, or B component is abnormal when the minimum pixel level value is smaller than the predetermined value, and resetting the flag when the minimum pixel level value is larger than the predetermined value.

10. The method of claim 7, wherein the displaying comprises:

checking whether a flag indicating whether the selected one R,G, or B component is abnormal is set;

checking if a video signal checking function is enabled when the flag is set; and setting how long the message will be displayed and how long a predetermined warning message is displayed on the screen when the video signal checking function is enabled.

11. A display device, comprising:

a signal inputting unit receiving R,G,B video signals, a horizontal synchronization signal and a vertical synchronization signal from a host of a computer system;

an abnormal state detector detecting an abnormal video signal in an R, a G, or a B component caused by malfunction of the host, the R, a G, or a B component selected from among the received R,G,B signals based on a comparison of a detected pixel level value of the selected one R,G, or B component and a predetermined value, the selected one R,G, or B component being an R, a G, or a B component of the received R,G,B signals; and a warning message indicator indicating whether a video signal abnormally input due to the malfunction of the host is detected.

12. The display device of claim 11, wherein the abnormal state detector comprises:

a minimum value detector detecting a minimum pixel level value in the selected one R,G, or B component; and a controller which compares the minimum pixel level value with a predetermined value and checks if the selected one R,G, or B component is abnormal.

13. The display device of claim 12, wherein the minimum value detector comprises:

a signal selector selecting one of the received R, G, or B components;

a storage unit storing the minimum pixel level value detected in the selected one R,G, or B component;

a comparator comparing the minimum pixel level value in the selected R,G,B component with a minimum pixel level value detected in a previous signal, and extracts a minimum pixel level value.

14. The display device of claim 12, wherein the controller generates a set flag when an abnormal signal is detected.

15. The display device of claim 11, wherein the controller generates an on-screen-display (OSD) signal that enables or disables a signal checking function.

16. A method of detecting an abnormal video signal in a display device, comprising:

receiving an R,G,B signal, a horizontal synchronization signal and a vertical synchronization signal from a host of a computer system;

selecting each of an R, a G, and a B component from an R,G,B signal received from a host of a computer system as a selected R,G, and B component and setting a region of the selected R,G, and B component as a checked region;

comparing the minimum pixel level value for the selected R,G, and B components with a predetermined threshold value to determine whether an abnormal R,G, and B component is present due to malfunction of the host, the abnormal R,G, or B component being a component abnormally input due to malfunction of the host; and displaying a message on a screen indicating whether the selected R,G, and B component includes a video signal abnormally input due to the malfunction of the host.

* * * * *